US009492917B2

(12) United States Patent
Testaverde

(10) Patent No.: US 9,492,917 B2
(45) Date of Patent: Nov. 15, 2016

(54) MULTI-FUNCTION HOPPER GUN STAND/TOOL HOLDER/WORK PLATFORM

(76) Inventor: Thomas R Testaverde, Chula Vista, CA (US)

( * ) Notice: Subject to any disclaimer, the term of this patent is extended or adjusted under 35 U.S.C. 154(b) by 509 days.

(21) Appl. No.: 13/011,834

(22) Filed: Jan. 21, 2011

(65) Prior Publication Data

US 2012/0187258 A1 Jul. 26, 2012

(51) Int. Cl.

| | |
|---|---|
| ***A47G 23/02*** | (2006.01) |
| ***B25H 1/04*** | (2006.01) |
| ***B25H 1/12*** | (2006.01) |
| ***B25H 1/18*** | (2006.01) |

(52) U.S. Cl.
CPC *B25H 1/04* (2013.01); *B25H 1/12* (2013.01); *B25H 1/18* (2013.01)

(58) Field of Classification Search
CPC ..... B25H 1/04; B25H 1/18; B25H 1/12
USPC ..... 248/146, 153, 155.1, 432, 175, 176.1, 248/95, 97, 128, 99, 907, 351, 126, 163.1, 248/163.2, 210; 182/129; 108/25, 14; 52/194, 197; 222/185.1; 239/373, 239/280.5, 149, 200, 129
See application file for complete search history.

(56) References Cited

U.S. PATENT DOCUMENTS

| | | | | |
|---|---|---|---|---|
| 2,044,326 | A * | 6/1936 | Pickell | 222/48 |
| 5,613,464 | A | 3/1997 | Petzel | |
| 5,893,469 | A | 4/1999 | Nozawa | |
| 5,996,947 | A * | 12/1999 | Palmieri, III | 248/146 |
| D440,477 | S * | 4/2001 | Pappas | D8/71 |
| 6,450,754 | B1 * | 9/2002 | Catton | 414/415 |
| 6,491,264 | B1 * | 12/2002 | Valesquez | 248/97 |
| 6,494,420 | B2 * | 12/2002 | Lucero | 248/129 |
| 6,536,590 | B1 * | 3/2003 | Godshaw et al. | 206/373 |
| 6,695,267 | B2 * | 2/2004 | Liao | 248/175 |
| 6,845,923 | B1 | 1/2005 | Slotsve | |
| 6,907,640 | B2 * | 6/2005 | Rougeau | 15/257.06 |
| 7,077,238 | B2 * | 7/2006 | Butler et al. | 182/129 |
| 7,497,327 | B2 * | 3/2009 | Martinez et al. | 206/225 |
| 7,621,496 | B2 * | 11/2009 | Cancilliari et al. | 248/318 |
| 8,231,087 | B1 * | 7/2012 | Giordano, Jr. | 248/166 |
| D678,746 | S * | 3/2013 | Kirby | D8/71 |
| 2002/0014563 | A1 * | 2/2002 | Lucero | 248/129 |
| 2002/0070136 | A1 * | 6/2002 | Hedges | 206/373 |
| 2002/0070137 | A1 * | 6/2002 | Hedges | 206/373 |
| 2003/0226946 | A1 * | 12/2003 | Liao | 248/316.7 |
| 2004/0129802 | A1 | 7/2004 | Bell, Sr. | |
| 2005/0067311 | A1 * | 3/2005 | Ferrante | 206/373 |
| 2005/0242249 | A1 * | 11/2005 | Weldy | 248/166 |
| 2005/0247585 | A1 * | 11/2005 | Breckwoldt et al. | 206/350 |

(Continued)

*Primary Examiner* — Christopher Garft
(74) *Attorney, Agent, or Firm* — Ariel S. Bentolila; Bay Area IP Group LLC

(57) ABSTRACT

An apparatus includes a frame having a generally trapezoidal shape with a front side and a back side. The frame includes two pairs of legs in which each pair comprises a top joining rail. A base bar joins the two pairs at bottom ends on the front side. The top joining rails are operable for supporting a hopper of a texture gun. A hinged work surface has is rotatably joined to the frame between the top joining rails. The hinged work surface is rotatable from a first position, where the hinged work surface rests on top of the joining rails, to a second position where the hinged work surface hangs downward between the pairs of legs. A stretcher joins the legs at a distance above the base bar where an open side of the stretcher faces the front side and the distance is chosen to be above typical construction debris.

8 Claims, 2 Drawing Sheets

(56) References Cited

U.S. PATENT DOCUMENTS

2007/0039552 A1 2/2007 Nicholes
2007/0108233 A1* 5/2007 Grayden ..... 222/181.1
2007/0145207 A1* 6/2007 Weldy ..... 248/166
2008/0277423 A1 11/2008 Garton
2011/0290803 A1* 12/2011 Kehres ..... 220/475

* cited by examiner

MULTI-FUNCTION HOPPER GUN STAND/TOOL HOLDER/WORK PLATFORM

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

The present invention relates generally to construction equipment. More particularly, the invention relates to a multi-function work platform for drywall tools.

BACKGROUND OF THE INVENTION

The present invention relates to a work platform for the drywall, home improvement, and general construction industries. These industries involve a large amount of repetitive lower back and deep knee bending including leaning over to perform tasks such as, but not limited to, making measurements and marking and cutting drywall and picking up large objects including, without limitation, hopper guns and buckets of joint compound. It is therefore an objective of the present invention to provide a work platform for drywall and construction tradesmen that reduces or eliminates repetitive lower back and deep knee bending.

Currently work platforms for the construction industry exist. However, there is nothing at this time that enables a tradesman the ability to individually and ergonomically carry, store and work from a single piece of equipment. Most of these current platforms are about 24 inches in height, which still requires some bending on the part of a user when performing tasks on these platforms. Also, some currently known platforms are made of plastic, which may not be strong enough for some tasks and may slip from a user's grasp when moving the platform. In addition, current platforms do not comprise tool holders. Most portable platforms that are currently known do not compensate for the tipping forward of the hopper that occurs when lifting a loaded hopper gun by its handle alone. Also, there are often many different tradesmen performing various different trades at a single job site, and a problem on a job site where multiple trades are working is the presence of obstacles such as, but not limited to, extension cords, two by fours, pipes, and drywall, which may be staged, stored or in the way. Many currently known work platforms do not provide clearance for these obstacles or have large footprints that require moving these obstacles in order to make room for the platform.

In view of the foregoing, there is a need for improved techniques for providing a multi-function work platform that is tall enough to reduce bending, that provides tool storage and is maneuverable around obstacles on the jobsite.

BRIEF DESCRIPTION OF THE DRAWINGS

The present invention is illustrated by way of example, and not by way of limitation, in the figures of the accompanying drawings and in which like reference numerals refer to similar elements and in which:

FIG. 2A is a front perspective view of the work stand with a hinged work surface in a closed position, and FIG. 2B is a front perspective view of the work stand with the hinged work surface in an open position with a hopper in place in the work stand.

Figure 1:
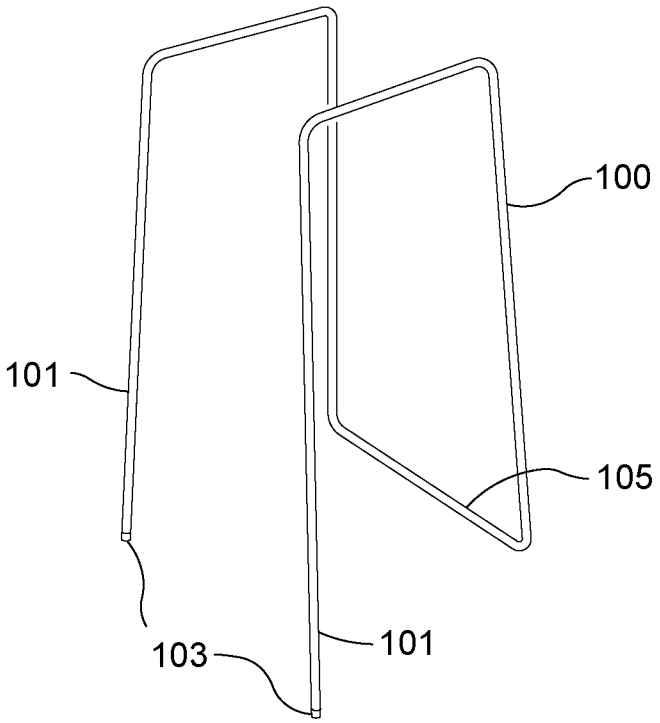
FIG. 1 is a front perspective view of an exemplary frame for a multi-function work stand, in accordance with an embodiment of the present invention.

Unless otherwise indicated illustrations in the figures are not necessarily drawn to scale.

DETAILED DESCRIPTION OF THE PREFERRED EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

Detailed descriptions of the preferred embodiments are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

It is to be understood that any exact measurements/dimensions or particular construction materials indicated herein are solely provided as examples of suitable configurations and are not intended to be limiting in any way. Depending on the needs of the particular application, those skilled in the art will readily recognize, in light of the following teachings, a multiplicity of suitable alternative implementation details.

A preferred embodiment of the present invention provides a lightweight and compact work stand that enables a user to fill and hold a texture gun without an assistant. In this embodiment the stand also stores multiple dry wall tools in combination, both securing the tools and protecting the tools from damage when not in use. At least some embodiments of the present invention described below may be used in the general construction industry with an emphasis on the drywall trades; however, some embodiments may be used in different trades such as, but not limited to, painting, decorating, acoustical ceiling trades, theater and movie set building, etc. Some embodiments may be used by do it yourselfers.

FIG. 1 is a front perspective view of an exemplary frame for a multi-function work stand, in accordance with an embodiment of the present invention. In the present embodiment, frame 100 is preferably fabricated from ⅜-inch hot rolled #3 rebar welded at all joints. The work stand often operates in a semi-wet environment and also must be able to be cleaned for example, without limitation, with water, a hose and a brush. Rebar is the preferred material because it is strong and has an anti-slip, ridged surface, enabling frame 100 to be securely gripped anywhere when wet or dry. However, in alternate embodiments the frame may be made of various different materials such as, but not limited to, different metals, wood, plastics, etc. In the present embodiment, as shown by way of example in FIGS. 2A and 2B, a hinged work surface, tool storage panels and magnets may be attached to frame 100 in order to provide added functionality. Those skilled in the art will readily recognize, in accordance with the teachings of the present invention, that various different tools and storage units may be attached to the fame in alternate embodiments such as, but not limited to, nail and screw buckets, hose and cord holders, magnetic plates for holding metallic objects, shelves for larger tools including, without limitation, saws, stud finders, hammers, etc.

In the present embodiment, frame 100 is preferably trapezoidal in shape and is 30 inches tall, 17 inches by 17 inches at the base and 10 inches by 11 inches at the top. However, work stands in alternate embodiments may be made in various different sizes, and some alternate embodiments may be adjustable in height and/or width. In the present embodiment, the dynamics of the trapezoidal shape provides a top to bottom anti-tip ratio of 1 to 2.88, meaning frame 100 does not tip over when pushed from the top up to 12 inches in any direction. This shape also enables frame 101 to be nested with other frames. Nested frames may be stacked up to ten frames high with a footprint of only 17 inches by 17 inches. Frame 101 comprises metal legs 101 on two corners capped with two feet 103 made of a non-skid material such as, but not limited to, vinyl or rubber and a bar 105 acting as a base connecting the other two corners. The non-skid material of feet 103 generally prevent slipping and protect the floor. Bar 105 acts as a foot hold down, as described by way of example in accordance with FIG. 2B. Those skilled in the art will readily recognize, in accordance with the teachings of the present invention, that alternate embodiments may be implemented with frames of various different shapes such as, but not limited to, rectangular or cylindrical frames and that frames in alternate embodiments may comprise various different configurations of feet and bars at the bottom. For example, without limitation, one alternate embodiment may be implemented with no feet and may instead comprise two bars, each connecting the corners of the opposite sides of the frame. Another alternate embodiment may comprise four bars connecting all of the corners to create a square base.

Figure 2A:
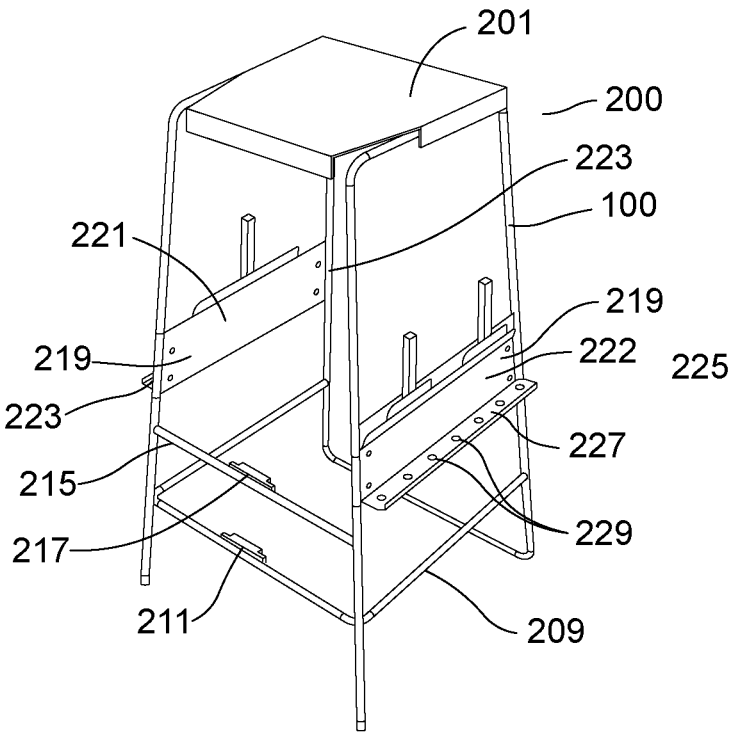
FIGS. 2A and 2B illustrate an exemplary multi-function work stand, in accordance with an embodiment of the present invention.
Figure 2B:
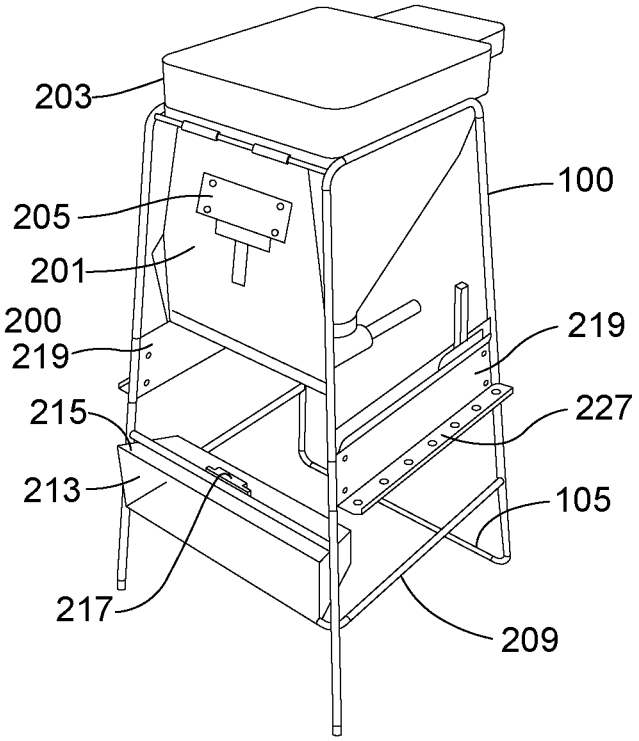

FIGS. 2A and 2B illustrate an exemplary multi-function work stand 200, in accordance with an embodiment of the present invention. FIG. 2A is a front perspective view of work stand 200 with a hinged work surface 201 in a closed position, and FIG. 2B is a front perspective view of work stand 200 with hinged work surface 201 in an open position with a hopper 203 in place in work stand 200. In the present embodiment, work surface 201 is a hinged 20-gauge top, which is contoured to a unique angle and shape that enables work surface 201 to pass and hang vertically between the back struts of a frame 100 when in the open position, as shown by way of example in FIG. 2B. When work surface 201 is in the open position, work stand 200 may be used to support a large object such as, but not limited to, a box or pail of joint compound. Work surface 201 comprises ¾-inch lips on four sides giving extra strength to the top of work stand 200 while keeping work surface 201 firmly in place against the side-to-side movement of containers placed on top of work surface 201, which may weigh 50 pounds or more. In alternate embodiments the work surface may not comprise lips on all four sides or may comprise larger or smaller lips. In the present embodiment, work surface 201 is preferably powder coated to protect surface 201 from rust and to enable surface 201 to accept silkscreen graphics. In alternate embodiments, the work surface may be made of various different materials such as, but not limited to, different types of metal, wood or plastic and may be finished by means other than powder coating such as, but not limited to, painting, staining, varnishing, epoxy coating, etc. Furthermore, the shape of the work surface may vary in alternate embodiments, for example, without limitation, to fit on frames of different shapes and sizes. In one alternate embodiment the frame may extend past the structure of the frame, either permanently or adjustably, in order to hold larger objects such as, but not limited to sheets of drywall. Referring to FIG. 2B, in the present embodiment, a galvanized knife/tool storage unit 205 designed to hold a special mud scooping blade 207 with a canted handle is located on the underside of work surface 201. Blade 207 may be drawn out of storage unit 205 when work surface 201 is in the open position. Alternate embodiments may be implemented without this storage unit.

Referring to FIG. 2A, in the present embodiment when work surface 201 is in the closed position, work surface 201 is located above table height at 30 inches tall for performing tasks such as, but not limited to, scooping from forty-nine pound cubes or five-gallon pails of joint compound, measuring items, cutting drywall, etc. Working at this height reduces the amount of repetitive lower back and deep knee bending required by the user. About 7 inches up from the bottom of frame 100 is a horizontal "C" shaped stretcher 209. Referring to FIG. 2B, stretcher 209 is "C" shaped in order to leave one side open for the removal of hopper 203 and the gun and compressor air hose typically attached to hopper 203. Stretcher 209 is preferably set at 7 inches to provide ground clearance for construction equipment and debris. In alternate embodiments the stretcher may be located higher or lower on the frame. Some alternate embodiments may comprise multiple stretchers, and other alternate embodiments may have no stretcher. Referring to FIG. 2A, in the present embodiment, the back of stretcher 209 is drilled for a magnetic holder 211 that holds the bottom of a mud pan 213, shown by way of example in FIG. 2B. A top bar 215 is also drilled to receive a magnetic holder 217 to hold the top of mud pan 213. Mud pan 213 is made of metal so that magnetic holders 211 and 217 hold it securely in place; however, in alternate embodiments plastic mud pans may be used and held in place using various different means including, but not limited to, clamps, hook and loop material, bolts, hooks, etc. In some alternate embodiments built in mud pans may be included. In the present embodiment, the stance of frame 100 enables it to sit in a 17-inch by 17-inch space, while only displacing one strip of ground contact of ⅜ of an inch by 17 inches and two points. This coupled with the 7 inches of ground clearance on three sides enables work stand 200 to be set in close quarters and to bridge up to a 2 inch by 6 inch area on edge.

In the present embodiment a two-part knife tool storage sheath 219 is located on each side of frame 100. Referring to FIG. 2A, storage sheaths 219 comprise two galvanized plates 221 and 222 riveted together creating a gap into which drywall knives may be placed. Storage sheaths in alternate embodiments may be made of various different materials such as, but not limited to, powder coated metal, painted metal, plastic, leather, etc. In the present embodiment, a back plate 221 is contoured to grip the side stanchions of frame 100 with a 180-degree channel 223 on each side. In alternate embodiments the storage sheaths may be attached using various different means including, without limitation, bolts, welding, brackets, U bolts, adhesives, etc. In the present embodiment, a front plate 222 comprises a 20-degree canted lip 225 facing outward. Lip 225 acts as a guide for receiving the knives into sheaths 219; however, this lip may not be included in alternate embodiments. In the present embodiment, storage sheaths 219 can hold a 12-inch taping knife on one side and an 8-inch and 4-inch knife on the other side. In alternate embodiments the storage sheaths may be configured to hold knives of various different sizes. In the present embodiment, a shelf 227 with a multiplicity of holes 229 for holding small hand tools such as, but not limited to, screw drivers is located on the front of each storage sheath 219. Alternate embodiments may be implemented without this shelf. In the present embodiment, galvanized sheaths 219 guard against blade damage, and the coating of sheaths 219 resists rust. Alternate embodiments may be implemented with more or fewer storage sheaths.

Referring to FIG. 2B, in the present embodiment the straight rails of the top of frame 100 enable a user to draw hopper 203 straight out of the front of work stand 200 without having to lift hopper 203 out of a recess or hole, as in some examples of prior art. The extra height of work stand 200 keeps the air hose from being kinked even with an extra ball valve shut off installed on the texture gun, as is often the case. When lifting a loaded hopper gun by its handle alone, the hopper gun has a tendency to tip forward. This imbalance necessitates the use of the user's second hand to level hopper 203 while lifting to generally prevent the liquid in hopper 203 from spilling. A bar 105 of frame 100 acts as a foot hold down that enables the user to hold down work stand 200 with his foot while using both hands to steady hopper 203.

In typical use of the present embodiment, the user places work stand 200 on a jobsite. Work stand 200 is lightweight and is easily transported around the job sight. The small footprint and ground clearance of work stand 200 enables it to be placed in a tight area near the user's work. The user may store his tools in storage sheaths 219 and storage unit 205 until they are needed. When a flat surface is needed, the user can place work surface 201 in the closed position in order to perform the needed task. Deep knee and back bending by the user is reduced by providing a work height of work surface 201 of 30 inches, which is six inches taller than most of the prior art. When using hopper 203 with a texture gun, the user places work surface 201 in the open position and places hopper 203 in the top of work stand 200. The user may then fill hopper 203. To remove hopper 203 from work stand 200 for use, the user places a foot on bar 105 and uses both hands to pull hopper 203 straight out through the front of work stand 200. The smooth removal of hopper 203 from work stand 200 and the stability of stand 200 enables hopper 203 to be filled fuller than with traditional hopper stands, which increases spraying time between refills.

Many features of the present embodiment are focused on ergonomics and generally eliminating lower back and deep knee bending, from moving the lightweight work stand 200 about the job site, to filling hopper 203, to lifting hopper 203 and the texture gun, to using the above table height work surface 201. The improved ergonomics of the present embodiment can increase safety and reduce back and knee injuries. Although no fixed height can please everyone, the height of work surface 201 at just over table height, 30 inches, is found to be a good height for most individuals for filling and lifting objects. Furthermore, much bending down is eliminated by enabling the user to place objects on top of work surface 201. For example, without limitation, the user may place a 49-pound joint compound box from which he scoops joint compound on work surface 201 rather than on the floor.

Those skilled in the art will readily recognize, in accordance with the teachings of the present invention, that alternate embodiments of the present invention may comprise a multiplicity of design variations. For example, without limitation, a professional model may be provided in one alternate embodiment that comprises a storage sheath capable of holding a larger 14-inch blade taping knife and a larger 16-inch mud pan and other tools such as, but not limited to, mud mixers and mashers, tape, drink holders, drill motors, etc. This would entail reconfiguring the trapezoidal frame by heightening the stand, widening the sheath and expanding the base footprint. Another alternate embodiment may comprise wheels for moving about the job site. The embodiment described in the foregoing does not to have wheels as obstacles on the job site may impede the use of wheels and wheels increase the footprint of the stand.

Having fully described at least one embodiment of the present invention, other equivalent or alternative methods of providing a work stand according to the present invention will be apparent to those skilled in the art. The invention has been described above by way of illustration, and the specific embodiments disclosed are not intended to limit the invention to the particular forms disclosed. For example, the particular implementation of the work stand may vary depending upon the particular type of elements used. The elements described in the foregoing were directed to non-adjustable implementations; however, similar techniques are to provide elements that may be adjusted to suit the preferences of the user. For example, without limitation, adjustable work stands may be provided with frames that adjust in height or width, storage sheaths and mud pans that may be attached to the frame in different locations and moved from location to location, an expandable work surface, etc. Adjustable implementations of the present invention are contemplated as within the scope of the present invention. The invention is thus to cover all modifications, equivalents, and alternatives falling within the spirit and scope of the following claims.

Claim elements and steps herein may have been numbered and/or lettered solely as an aid in readability and understanding. Any such numbering and lettering in itself is not intended to and should not be taken to indicate the ordering of elements and/or steps in the claims.

What is claimed is:

1. An apparatus comprising:

a frame having a generally trapezoidal shape with a front side and a back side, said frame comprising two pairs of legs in which each pair comprises a top joining rail joined to tops of said pair of legs and extending from said front side to said back side;

a base bar for joining said pairs of legs at bottom ends of said pairs of legs on said front side;

means for supporting a hopper of a texture gun and for enabling sliding of the hopper for removal of the hopper from the apparatus, in which said base bar is operable for stabilizing the apparatus while sliding the hopper;

means for rotatably positioning a work surface on a top of said means for supporting from a downward hanging position between at least two legs of said means for supporting to a horizontal position at least being operable for supporting containers of joint compound;

means for removably joining a mud pan to said supporting means; and a C shaped stretcher joining said at least two legs at a distance above said base bar where an open side of said stretcher faces said front side in order to leave one side open for the removal of said hopper of said texture gun.

2. The apparatus as recited in claim 1, further comprising means for storing knife tools on said means for supporting.

3. The apparatus as recited in claim 1, further comprising means for holding small hand tools.

4. The apparatus as recited in claim 1, further comprising means for removably joining a mud scooping blade to a bottom surface of said work surface.

5. The apparatus as recited in claim 1, further comprising means for mitigating slippage of said means for supporting on a floor and damage to the floor.

6. An apparatus comprising:

a frame having a generally trapezoidal shape with a front side and a back side, said frame comprising two pairs of legs in which each pair comprises a top joining rail joined to tops of said pair of legs and extending from said front side to said back side, and a base bar joining said two pairs at bottom ends of opposing legs on said front side, said top joining rails being operable for supporting a hopper of a texture gun;

a hinged work surface having a top surface and a bottom surface, said hinged work surface being rotatably joined to said frame between said top joining rails proximate said back side, said hinged work surface being rotatable from a first position, where said hinged work surface rests on top of said joining rails, to a second position where said hinged work surface hangs downward between said pairs of legs;

a C shaped stretcher joining said at least two legs at a distance above said base bar where an open side of said stretcher faces said front side; and means for removably joining a mud pan to said back side at a position above said stretcher.

7. The apparatus as recited in claim 6, in which the apparatus can be nested with other like frames.

8. An apparatus comprising:

a frame having a generally trapezoidal shape with a front side, a back side, a right side and a left side, in which a bottom width is larger than a top width, said frame comprising: at least four legs; a right side joining rail joining top ends of legs on said right side; a left side joining rail joining top ends of legs on said left side; a base bar joining bottom ends of legs on said front side; a C shaped stretcher joining said legs at a distance above said base bar where an open side of said stretcher faces said front side; and feet joined to bottom ends of legs on said back side for mitigating slippage of said frame on a floor and damage to the floor, where said right side joining rail and said left side joining rail are operable for supporting a hopper of a texture gun and enabling sliding of the hopper for removal of the hopper from the apparatus, in which said base bar is operable for stabilizing the apparatus while sliding the hopper;

a hinged work surface having a top surface and a bottom surface, said hinged work surface being rotatably joined to said frame between said right side joining rail and said left side joining rail proximate said back side, said hinged work surface being rotatable from a first position, where said hinged work surface rests on top of said right side joining rail and said left side joining rail, to a second position where said hinged work surface hangs downward between said legs on said back side;

means for removably joining a mud pan to said back side at a position above said stretcher;

means for removably joining a mud scooping blade to said bottom surface where the mud scooping blade is accessible with said hinged work surface in said second position;

at least one knife tool storage sheath joined to said right side or said left side at a position above said stretcher; and means, joined to said at least one knife tool storage sheath, for holding small hand tools, whereby the apparatus functions as a multi-function work platform for drywall tools.

* * * * *